US008666629B2

(12) United States Patent
Fekete et al.

(10) Patent No.: US 8,666,629 B2
(45) Date of Patent: Mar. 4, 2014

(54) METHOD AND APPARATUS FOR DETERMINING A DRIVING STRATEGY

(75) Inventors: Sandor Fekete, Braunschweig (DE); Christopher Tessars, Braunschweig (DE); Christiane Schmidt, Braunschweig (DE); Axel Wegener, Uslar (DE); Stefan Fischer, Luebeck (DE); Horst Hellbrueck, Luebeck (DE)

(73) Assignee: Technische Universitaet Braunschweig, Braunschweig (DE)

( * ) Notice: Subject to any disclaimer, the term of this patent is extended or adjusted under 35 U.S.C. 154(b) by 357 days.

(21) Appl. No.: 13/063,776

(22) PCT Filed: Sep. 4, 2009

(86) PCT No.: PCT/DE2009/001242
§ 371 (c)(1),
(2), (4) Date: May 12, 2011

(87) PCT Pub. No.: WO2010/028626
PCT Pub. Date: Mar. 18, 2010

(65) Prior Publication Data

US 2011/0208399 A1 Aug. 25, 2011

(30) Foreign Application Priority Data

Sep. 12, 2008 (DE) ..... 10 2008 047 143

(51) Int. Cl.
*G08G 1/0967* (2006.01)

(52) U.S. Cl.
CPC ..... *G08G 1/096725* (2013.01)
USPC ..... 701/93; 340/905

(58) Field of Classification Search
USPC ..... 701/23, 93; 340/905
See application file for complete search history.

(56) References Cited

U.S. PATENT DOCUMENTS

| | | | | |
|---|---|---|---|---|
| 6,397,141 | B1 | 5/2002 | Binnig | |
| 8,229,644 | B2 * | 7/2012 | Boecker et al. | 701/96 |
| 2005/0225457 | A1 | 10/2005 | Kagawa | |
| 2006/0235597 | A1 | 10/2006 | Hori | |
| 2008/0114531 | A1 | 5/2008 | Kagawa | |
| 2009/0299598 | A1 | 12/2009 | Boecker | |

FOREIGN PATENT DOCUMENTS

| | | | | |
|---|---|---|---|---|
| DE | 19750942 | A1 | 5/1999 | |
| DE | 10029816 | A1 | 1/2002 | |
| DE | 10130768 | C2 | 1/2003 | |
| DE | 10200883 | B4 | 1/2003 | |
| DE | 10349434 | A1 | 6/2004 | |
| DE | 102005050277 | A1 | 4/2007 | |
| DE | 102007037329 | A1 | 2/2008 | |
| DE | 102007053738 | A1 | 5/2008 | |
| EP | 1699033 | A2 | 9/2006 | |
| WO | WO 0197196 | A1 * | 12/2001 | G08G 1/09 |

OTHER PUBLICATIONS

Search Report for International Application No. PCT/DE2009/001242 mailed Nov. 20, 2009.

* cited by examiner

*Primary Examiner* — Fahd A Obeid
*Assistant Examiner* — Jeffrey Boomer
(74) *Attorney, Agent, or Firm* — Leydig, Voit & Mayer, Ltd.

(57) ABSTRACT

A method for determining a driving strategy for a driver of a motor vehicle includes receiving local information about a plurality of other motor vehicles using a receiving device, wherein the plurality of other motor vehicles are ahead of the motor vehicle and are relevant to the traffic situation. The method further includes recording the local information using the receiving device and deriving driving information from the local information so as to provide a driving strategy in the form of at least one action recommendation for the driver, the at least one action recommendation including a recommended speed based on an average speed of the plurality of other motor vehicles and on a desired speed of the motor vehicle.

17 Claims, No Drawings

METHOD AND APPARATUS FOR DETERMINING A DRIVING STRATEGY

CROSS REFERENCE TO PRIOR APPLICATIONS

This application is a U.S. National Phase application under 35 U.S.C. §371 of International Application PCT/DE2009/001242, filed on Sep. 4, 2009 and claiming benefit to German application no. DE 10 2008 047 143.7, filed on Sep. 12, 2008. The International Application was published in German on Mar. 18, 2010 as WO 2010/028626 under PCT Article 21 (2).

FIELD

The invention relates to a method for determining a driving strategy as information for the driver of a motor vehicle, in which in particular local information about other motor vehicles, in particular motor vehicles driving ahead, is recorded by a receiving means and information derived therefrom is prepared for the driver of the motor vehicle. The invention also relates to a device for implementing the method.

BACKGROUND

Communications systems of this type for the direct exchange of information between motor vehicles already form a communication platform for a wide spectrum of information services and transport telematics applications. In particular, diverse proposals are already known from the state of the art for optimising the flow of traffic based on stationary data, but particularly also based on data established by motor vehicles, about the traffic situation.

Road traffic is one of the most important and complex systems of our modern world. The levels of complexity which occur in this context range from individual actions by individual motor vehicle drivers, through local phenomena such as density variations and traffic congestion, the choice of driving route and driving time by the road user, local and temporal traffic patterns and national traffic flows, to long-term traffic development and traffic regulation.

Particular challenges are presented by the complex interaction between the numerous road users. This results in complicated phenomena which are difficult to control and adversely affect the flow of traffic in a very undesirable fashion. An example of this is a traffic jam where, for various reasons, with high densities of motor vehicles, the traffic is reduced to a stop-and-go manner of driving. This entails a reduced flow of traffic, increased journey times, stressful situations for drivers and an increased risk of accidents.

These problems have a particularly serious impact due to the increased energy consumption associated therewith and the environmental pollution resulting therefrom.

Communications systems between a plurality of motor vehicles are devised as an ad-hoc network. Therefore, they do not depend on any pre-installed network infrastructure and allow in particular the exchange of data in the local or regional surroundings of a motor vehicle.

In addition to typical Internet and telematics applications, these radio networks will support traffic-based applications, for example danger warnings and cooperative driver assistance systems. The communication via a plurality of motor vehicles opens up a new dimension for the provision of telematics applications, in that data of systems of vehicles travelling ahead is made available, such as the driving situation, detected by sensors, of the motor vehicle or data from camera or radar systems.

DE 10 2007 053 738 A1 generally discloses a vehicle-to-vehicle communication device for communication between motor vehicles, in which the transmitting vehicle passes on not only its own data, but also information about adjacent vehicles.

Furthermore, US 2005/0225457 A1 discloses a method in which not only the positional information of a vehicle equipped with the communication device is transmitted, but also the positional information of surrounding, correspondingly equipped vehicles which is recorded by a camera or the like.

The information is generally represented by visualisation on a display. For example, pictograms with an information content of, for example "risk of congestion" or "road works" are used for this purpose. DE 102 00 883 B4 discloses a method for representing information on a screen, for example on the screen of a navigation device in a motor vehicle.

In recent years, some approaches have been developed which focus on the individual driver. These include so-called assistance systems which are to ensure enhanced driving comfort and increased safety. Examples are for example tempostats, also called "cruise control". Recently, advanced approaches have also been developed, known as "adaptive cruise control", which also consider the driving behaviour, detected by sensors installed in the vehicle, of the vehicle which is immediately in front.

Thus, DE 103 49 434 A1 discloses how such a distance and speed regulation in stop-and-go situations can be brought into a different mode to avoid a constant jerky movement of vehicles stopping and starting. Methods of this type are based on information detected by appropriate sensors of the motor vehicle, and in particular on the speed of said vehicle. An exchange of information between a plurality of motor vehicles is not provided in this case.

According to the teaching of DE 10 2005 050 277 A1, the behaviour of a vehicle driving ahead is also detected by sensors.

DE 10 2007 037 329 A1 describes a method for determining a driving strategy to optimise the operating costs, in particular the fuel consumption. For this purpose, information can be detected by sensors of the vehicle and measures can be indicated to improve the operating state. The method is an optimisation of different parameters which are assumed to be known and which play a part in the choice of route.

DE 101 30 768 C2 discloses a channel access method for ad-hoc radio networks for the exchange of data between vehicles.

Furthermore, DE 197 50 942 A1 discloses a method and a device for determining a driving strategy as information for the driver of a motor vehicle, information of other motor vehicles being recorded by a receiving means and information derived therefrom for the vehicle driver is provided as a signal for reducing the speed.

In addition, DE 100 29 816 A1 relates to a driver-assisting system for an optimum manner of driving. To calculate the driving recommendations, data for detecting the driver's own driving situation and the traffic situation which lies ahead is considered while including GPS data to establish the current vehicle location and including digital road maps to ascertain the local layout of the road and an output of computer-assisted driving recommendations to the system user who is calling up.

Furthermore, technical systems known as traffic-influencing installations are also already frequently used on motorways and dual carriageways which improve the flow of traffic on one or more sections or nodes or in the entire network by a collective influence. The objective of traffic-influencing installations is to increase the traffic safety by reducing the speed variance in the vehicle collective and to optimally distribute the journeys over the available infrastructure, in addition to improving the traffic quality for the user and to prevent unstable traffic situations, such as shock waves and traffic jams. Stationary signals and traffic signs are used to convert the connected strategy into visual symbols for the driver, for example to restrict his speed.

The alternating installations, currently used in practice, to influence the traffic suffer from the disadvantage that they provide relatively unspecific speed restrictions which are therefore often unnecessary and are largely disregarded by road users. In the long run, they no longer fulfill their purpose in a traffic jam because generally the traffic is no longer moving fast anyway; the time and energy-consuming stop-and-go waves in the congestion are not prevented thereby.

It would also be possible to provide, in addition to the information about the risk of congestion, information about the exact extent of and the speed of the vehicles involved in the congestion. This type of information provision overburdens the road user and ultimately does not lead to the correct conclusions. Instead, the road user is also diverted from the traffic situation.

However, in practice, because such information is relatively abstract and is often unverifiable by the road user, he/she will initially briefly note said information and then will often completely ignore it.

A further approach is the so-called electronic drawbar by which motor vehicles are to be forced to form exactly synchronised convoys at a relatively high speed and with a small distance. In this way, fast overtaking maneuvers for cars could achieve a reduction in the fuel consumption and thus in environmental pollution with better utilised roads and due to the lower air resistance of the individual vehicles.

The electronically coupled motor vehicle is oriented by means of a computer-assisted image processing system on the vehicle ahead. A video camera records a specific pattern on the rear end of the front vehicle. From this, the computer calculates direction, distance and relative speed and adapts the following vehicle accurately thereto. Alternatively, infrared light sources can also generate the pattern, which does entail an increase in cost, but also an increase in the evaluation reliability for this measure. In addition to the high demands for technical reliability of such systems, a further disadvantage is the question of liability in the case of fault-induced damage.

In principle, macroscopic approaches are too cumbersome and too slow to promptly influence the traffic dynamics. A traffic jam is only recognised when it has already reached a certain size. Added to this is the imprecision of the traffic detection by the restricted stationary measuring points, which suffer from considerable inaccuracies. Even the emerging replacement of the traffic radio by navigation devices only influences the choice of route, thus particularly a bypassing of the congestion, but not the behaviour of the traffic in the traffic jam itself.

SUMMARY OF THE INVENTION

An aspect of the invention is to provide a possibility of simultaneously reducing the energy consumption as well as the journey times and risk of accidents and improving the flow of traffic as a result.

Therefore, according to the invention, a method is provided for determining a driving strategy as information for the driver of a motor vehicle, in which information about other motor vehicles is recorded by a receiving means and information derived therefrom is prepared for the driver, the provision of information comprising at least one action recommendation for a recommended speed determined from the average speed of a plurality of motor vehicles driving ahead which are relevant to the traffic situation and from the desired speed of the motor vehicle. Consequently, a driver is provided for the first time with an individual action recommendation for an optimum speed which is not, for example based on a blanket observation of the traffic situation but is derived from the detected information of vehicles which are driving ahead. Unlike stationary signal installations, due to the high accuracy of this instruction, comprehensive acceptance by the respective driver is ensured, as is nearly always the case today with navigation systems. Added to this is a measurable and significant reduction in the energy consumption gained by following the instruction. Thus, the driver recognises the action instruction as a real advantage to his driving behaviour and will increasingly base his action on this instruction because of the positive experiences associated therewith. Unlike car-to-car radio networks known hitherto, not only is status data transmitted, but specific optimisation proposals are derived therefrom which offer the driver the expected benefit if he follows these proposals. As a result, in a surprisingly simple manner the energy consumption is significantly reduced and the traffic flow is also improved, with the risk of accidents decreasing at the same time. In addition or as an alternative, the derived information can be transmitted to an assistance system, for example an adaptive cruise control.

In this respect, the recommended speed $v_{emp}$ can preferably be determined by the formula:

$$v_{emp}=\min(v_{des},\lambda v_{des}+(1-\lambda)v_{avg})$$

where $v_{emp}$=recommended speed $v_{des}$=desired speed, particularly as a function of physical aspects and safety aspects $v_{avg}$=average speed of motor vehicles driving ahead $\lambda$=compensation parameter.

In principle, the method proves to be helpful even in the case of a single motor vehicle driving ahead. However, it is even more advantageous if the information about a plurality of motor vehicles, in particular at least five vehicles, driving ahead is recorded so as to prevent a possible traffic jam formation. Even with a small number of detected vehicles, the method according to the invention results in a relatively comfortable and stress-free manner of driving without unnecessary braking and accelerating procedures.

The compensation parameter could be established dynamically on the basis of recorded information, in particular on the basis of experimental values. However, it has proved to be particularly useful if a value between 0 and 1, but in particular between ½ and ⅔, is determined as the equalizing parameter $\lambda$.

An advantageous configuration of the method according to the invention is achieved in that the optimum speed is determined from measured values of the speed of the driver's own vehicle and from the received information of the speed of a plurality of vehicles ahead. In this respect, the risk of congestion is reduced in that the driver is provided with a speed recommendation with a reduced speed, in which the temporal change in the traffic situation, in particular of the vehicles ahead, has already been taken into account in relation to density, the average speed or the local spread. Compared to a static traffic-influencing installation, the difference between the proposed driving speed and the desired speed is smaller.

It proves to be promising if the transmitted information at least comprises the position and speed of a respective vehicle driving ahead so as to be able to draw appropriate conclusions about the change in the future traffic situation on the one hand and in the corresponding driver's own optimum speed on the other hand.

In this respect, it could be conceivable that a speed corresponding to the average speed of a plurality of vehicles driving ahead would be advisable. However, in contrast thereto, it is advantageous in practice if the recommended speed is between the instantaneous speed of the vehicle and the average speed of a plurality of vehicles driving ahead which are relevant to the traffic situation, so that theoretically the driver's own vehicle approaches the vehicles ahead. However, the decelerated approach results in a partial reduction in the vehicle density of the vehicles ahead and thus in a breaking up of already existing areas of slow-flowing traffic. Of course, the factor determining the speed recommendation may itself depend on the average speed.

In principle, the method according to the invention manages without a localised infrastructure because all relevant information is recorded by the participating vehicles. A useful supplementation is realised when information from stationary or fixed information sources is also recorded so as also to be able to include further available information about the traffic situation in the calculation of the optimum speed. In particular, in this way it is also possible for vehicles to be detected which are not equipped with the requirements for car-to-car information transmission.

It is also practical if the determined recommended speed is visualised on a display and can thus be directly read by the driver as an amount. In a useful manner, the deviation of the optimum speed from the instantaneous speed can also be visualised, in which case a multi-coloured representation in particular makes it easier to read the display.

Furthermore, in addition or as an alternative, acoustic information is also conceivable. Alternatively, the recommended speed which is thus determined can also be transferred to an assistance system.

Furthermore, it is promising if additionally the variations in the speed of vehicles driving ahead are determined, so as also to be able to derive qualitative information about the traffic situation of the detected vehicles. Thus, possible road risks can be recognised at an early stage, for example due to noticeable signals.

According to a modification, the information provided for the vehicle driver can also be transmitted to other vehicles so that not only the instantaneous traffic situation, but also the expected traffic situation can be considered.

It also proves to be purposeful if the information, in particular derived information is transferred to other vehicles by a transmitting unit so that the vehicles in the vicinity can also include the derived information in their own information provision.

Furthermore, an indication, which can be recognised by other road users, of active participation in the method can also be provided. Devices which use visually perceivable markings or indications to provide information not only about the corresponding vehicle equipment, but also about the instantaneous active participation in the system, are suitable for this purpose.

The method is not only restricted to motor vehicles. Instead, the method can also be used in the optimisation of traffic flows of cyclists, pedestrians, including sportspeople engaging in various types of sport, and also water craft.

The invention claimed is:

1. A method for determining a driving strategy for a driver of a motor vehicle, the method comprising:

receiving local information about a plurality of other motor vehicles using a receiving device, wherein the plurality of other motor vehicles are ahead of the motor vehicle and are relevant to the traffic situation;

recording the local information using the receiving device; and deriving driving information from the local information so as to provide a driving strategy in the form of at least one action recommendation for the driver, the at least one action recommendation including a recommended speed ($v_{emp}$) that is based on received speeds of the plurality of other motor vehicles and on a measured actual speed of the motor vehicle, wherein the recommended speed ($v_{emp}$) is determined from a minimum of ($v_{des}$, $\lambda v_{des}+(1-\lambda)v_{avg}$), wherein $v_{emp}$=the recommended speed, $v_{des}$=a desired speed, $v_{avg}$=an average speed of the plurality of other motor vehicles, and $\lambda$ is a compensation parameter.

2. The method as recited in claim 1, further comprising assigning a value between 0 and 1 to the compensation parameter.

3. The method as recited in claim 2, wherein the value is between ½ and ⅔.

4. The method as recited in claim 1, wherein the local information includes at least a position and a speed of each of the plurality of other motor vehicles.

5. The method as recited in claim 1, wherein the plurality of other motor vehicles includes at least 5 other motor vehicles.

6. The method as recited in claim 1, wherein the recording includes recording information from fixed information sources.

7. The method as recited in claim 1, further comprising visualizing the recommended speed on a display.

8. The method as recited in claim 1, further comprising supplying the recommended speed to an assistance system.

9. The method as recited in claim 8, wherein the assistance system is a cruise control system.

10. The method as recited in claim 1, wherein the determining includes considering a variation of the speeds of each of the plurality of other motor vehicles.

11. The method as recited in claim 1, further comprising transmitting the driving information to the plurality of other motor vehicles using a transmitting unit.

12. A device for determining a driving strategy for a driver of a motor vehicle, the device comprising:

a receiving device configured to receive and record local information about a plurality of other motor vehicles, wherein the plurality of other motor vehicles are ahead of the motor vehicle and are relevant to the traffic situation; and an output unit configured to derive driving information from the local information so as to provide the driving strategy to the driver, the strategy including at least a recommended speed ($v_{emp}$) that is based on received speeds of the plurality of other motor vehicles and on a measured actual speed of the motor vehicle, wherein the recommended speed ($v_{emp}$) is determined from a minimum of ($v_{des}$, $\lambda v_{des}+(1-\lambda)v_{avg}$), wherein $v_{emp}$=the recommended speed, $v_{des}$=a desired speed, $v_{avg}$=an average speed of the plurality of other motor vehicles, and $\lambda$ is a compensation parameter.

13. The device as recited in claim 12, wherein the compensation parameter is between 0 and 1.

14. The device as recited in claim 13, wherein the compensation parameter is between ½ and ⅔.

15. The device as recited in claim 12, wherein the local information includes at least a position and a speed of each of the plurality of other motor vehicles.

16. The device as recited in claim 12, wherein the plurality of other motor vehicles includes at least 5 other motor vehicles.

17. The device as recited in claim 12, further comprising a display configured to visualize the recommended speed.

* * * * *